US011405710B2

(12) United States Patent
Lin et al.

(10) Patent No.: US 11,405,710 B2
(45) Date of Patent: Aug. 2, 2022

(54) EARPHONE CASE

(71) Applicant: Merry Electronics(Shenzhen) Co., Ltd., ShenZhen (CN)

(72) Inventors: Jia-Xin Lin, Taichung (TW); Wei-Hao Tu, Taichung (TW); Feng-Ping Chang, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 564 days.

(21) Appl. No.: 16/575,389

(22) Filed: Sep. 19, 2019

(65) Prior Publication Data

US 2021/0029433 A1 Jan. 28, 2021

(30) Foreign Application Priority Data

Jul. 23, 2019 (TW) ..... 108126060

(51) Int. Cl.

| | |
|---|---|
| ***B65D 85/00*** | (2006.01) |
| ***H04R 1/10*** | (2006.01) |
| ***B65D 43/22*** | (2006.01) |
| ***H01F 7/02*** | (2006.01) |

(52) U.S. Cl.

CPC ..... *H04R 1/10* (2013.01); *B65D 43/22* (2013.01); *H01F 7/02* (2013.01)

(58) Field of Classification Search

CPC ..... H04R 1/10; B65D 43/22; H01F 7/02

See application file for complete search history.

(56) References Cited

U.S. PATENT DOCUMENTS

| | | | | |
|---|---|---|---|---|
| 11,172,101 | B1 * | 11/2021 | Boozer | H04N 5/23241 |
| 2017/0094399 | A1 * | 3/2017 | Chandramohan | H04R 5/033 |
| 2018/0091887 | A1 * | 3/2018 | Minoo | H04R 1/1025 |
| 2020/0086513 | A1 * | 3/2020 | Ambielli | B25F 1/006 |
| 2020/0107110 | A1 * | 4/2020 | Ji | H04R 1/1091 |
| 2020/0216228 | A1 * | 7/2020 | Wang | B65D 25/04 |

* cited by examiner

*Primary Examiner* — Simon King
(74) *Attorney, Agent, or Firm* — JCIPRNET

(57) ABSTRACT

An earphone case includes a body, a storage member, a cover, and a reset member. The body has a chamber and a fixing base. The base is securely disposed in the chamber. The storage member is disposed in the chamber, located above the fixing base, contacted with the body, and has multiple first magnetic parts. The cover is pivotally connected to the storage member and the fixing base, and the cover has multiple second magnetic parts. The reset member is disposed above the fixing base and connected to the body and the storage member respectively. In close mode, the cover completely covers the storage member. The multiple first magnetic parts and second magnetic parts are magnetically attracted to each other. In open mode, the cover is relatively separated from the storage member and rotated at an angle, such that the cover partially overlaps with the storage member.

13 Claims, 8 Drawing Sheets

EARPHONE CASE

CROSS-REFERENCE TO RELATED APPLICATION

This application claims the priority benefit of Taiwan application serial no. 108126060, filed on Jul. 23, 2019. The entirety of the above-mentioned patent application is hereby incorporated by reference herein and made a part of this specification.

BACKGROUND

Technical Field

The disclosure relates to a case, and more particularly to an earphone case.

Description of Related Art

Nowadays when mobile devices such as smartphones and tablets are prevailing, earphones have become indispensable accessories. After being connected to a mobile device, earphones can be configured to output audio without causing noise of excessive volume, which are suitable for public places or indoor venues. Conventional earphones can be divided into two types, wired earphones and wireless earphones.

Regarding of being wired or wireless earphones, earphones are stored in a case to avoid dust and damage. Most conventional earphone cases adopt a flip cover method, and the disadvantage is that the cover and the box are connected through a rotating shaft as a pivoting element of the two. However, the manufacturing cost of a metal rotating shaft is relatively high. Also, an additional jig is required to assist installation when the cover and the box are being assembled, resulting in a complicated manufacturing process and cost increase. In addition, the conventional flip cover method requires an entirely manual operation, which is inconvenient to use.

SUMMARY

The disclosure provides an earphone case, which has the function of automatically opening and aligning, configured to replace an entirely manual cover opening method.

The earphone case of the disclosure includes a body, a storage member, a cover, and a reset member. The body has a chamber and a fixing base. The fixing base is securely disposed in the chamber. The storage member is disposed in the chamber and located above the fixing base. The storage member is contacted with the body and has a plurality of first magnetic parts. The cover is pivotally connected to the storage member and the fixing base, and the cover has a plurality of second magnetic parts. The reset member is disposed above the fixing base and the reset member connected to the cover and the storage member respectively. In close mode, the cover completely covers the storage member, and the plurality of first magnetic parts and the plurality of second magnetic parts are magnetically attracted to each other. In open mode, the reset member drives the cover to be relatively separated from the storage member and rotated at an angle, such that the cover partially overlaps with the storage member, and part of the plurality of first magnetic parts and part of the plurality of second magnetic parts are magnetically attracted to each other.

Based on the above, the earphone case of the disclosure allows the body and the storage member to be contacted with each other, and the cover to be pivotally connected to the storage member and the fixing base of the body. The storage member and the cover are connected by the reset member, when the earphone case is in close mode, the cover covers the storage member, and the plurality of first magnetic parts and the plurality of second magnetic parts are magnetically attracted to each other to position the cover. When the earphone case is in open mode, an external force needs to be exerted to overcome the magnetic attraction of the plurality of first magnetic parts and the plurality of second magnetic parts. Then, the cover is driven by the reset member to be rotated to a specific position relative to the storage member, such that corresponding part of the plurality of first magnetic parts and part of the plurality of second magnetic parts are magnetically attracted to each other. As such, the effect of automatically opening the cover can be achieved without having to manually adjust the position of the cover.

To make the aforementioned and other features of the disclosure more comprehensible, several embodiments accompanied with drawings are described in detail as follows.

DETAILED DESCRIPTION OF DISCLOSED EMBODIMENTS

Figure 1A:
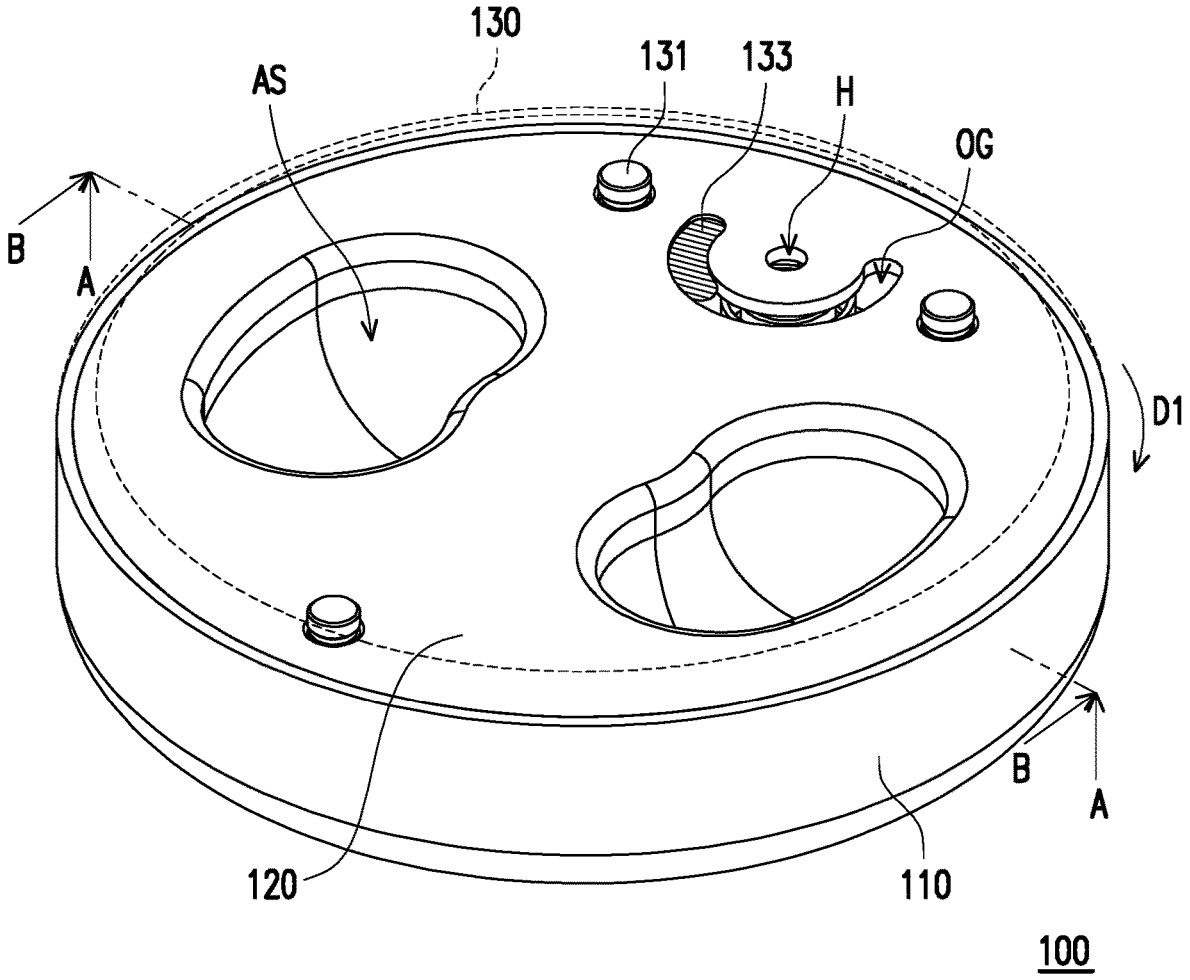
FIG. 1A is a perspective view of an earphone case in close mode according to an embodiment of the disclosure.
Figure 1B:
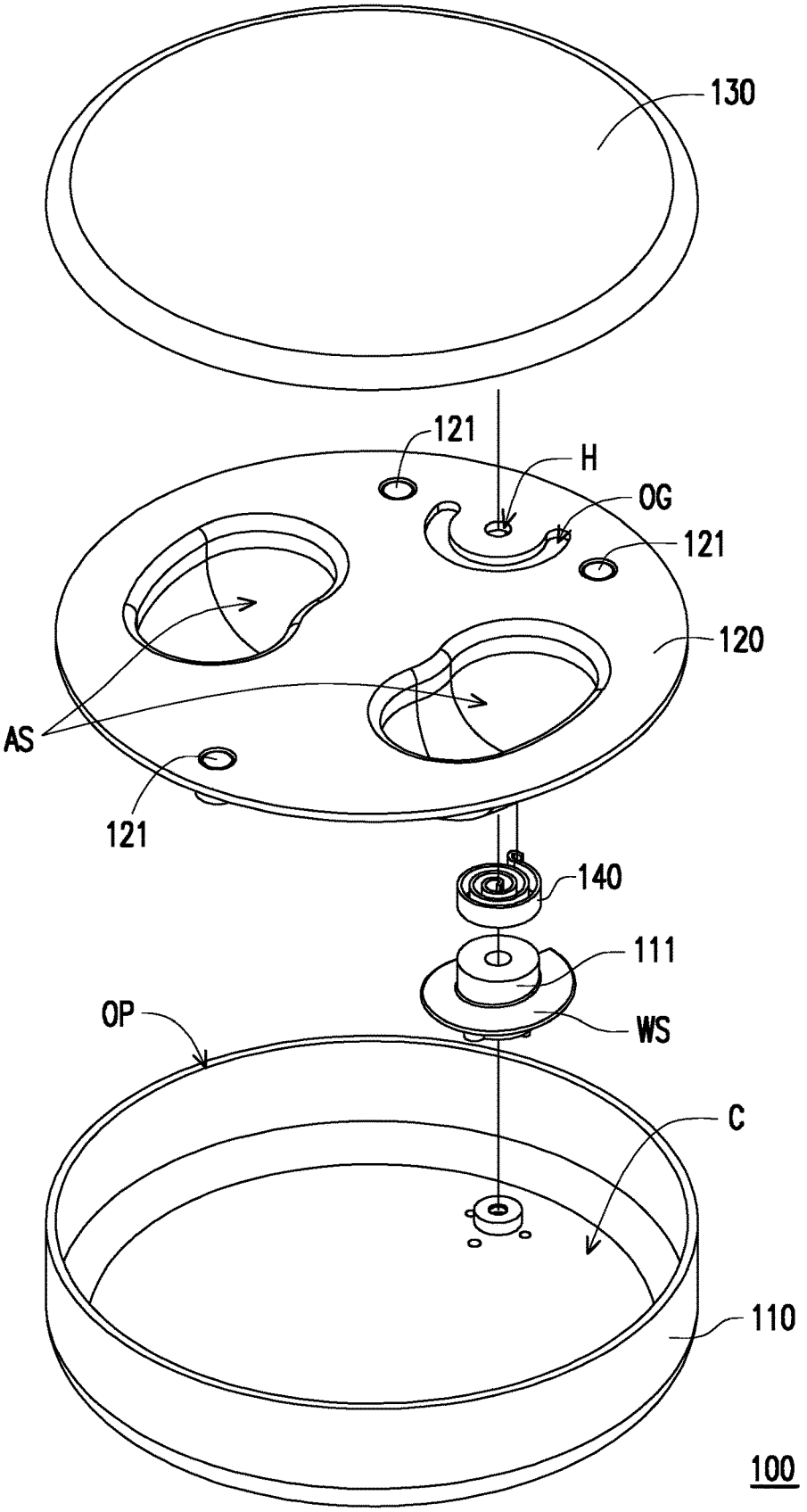
FIG. 1B is an exploded perspective view of components of the earphone case of FIG. 1A.
Figure 1C:
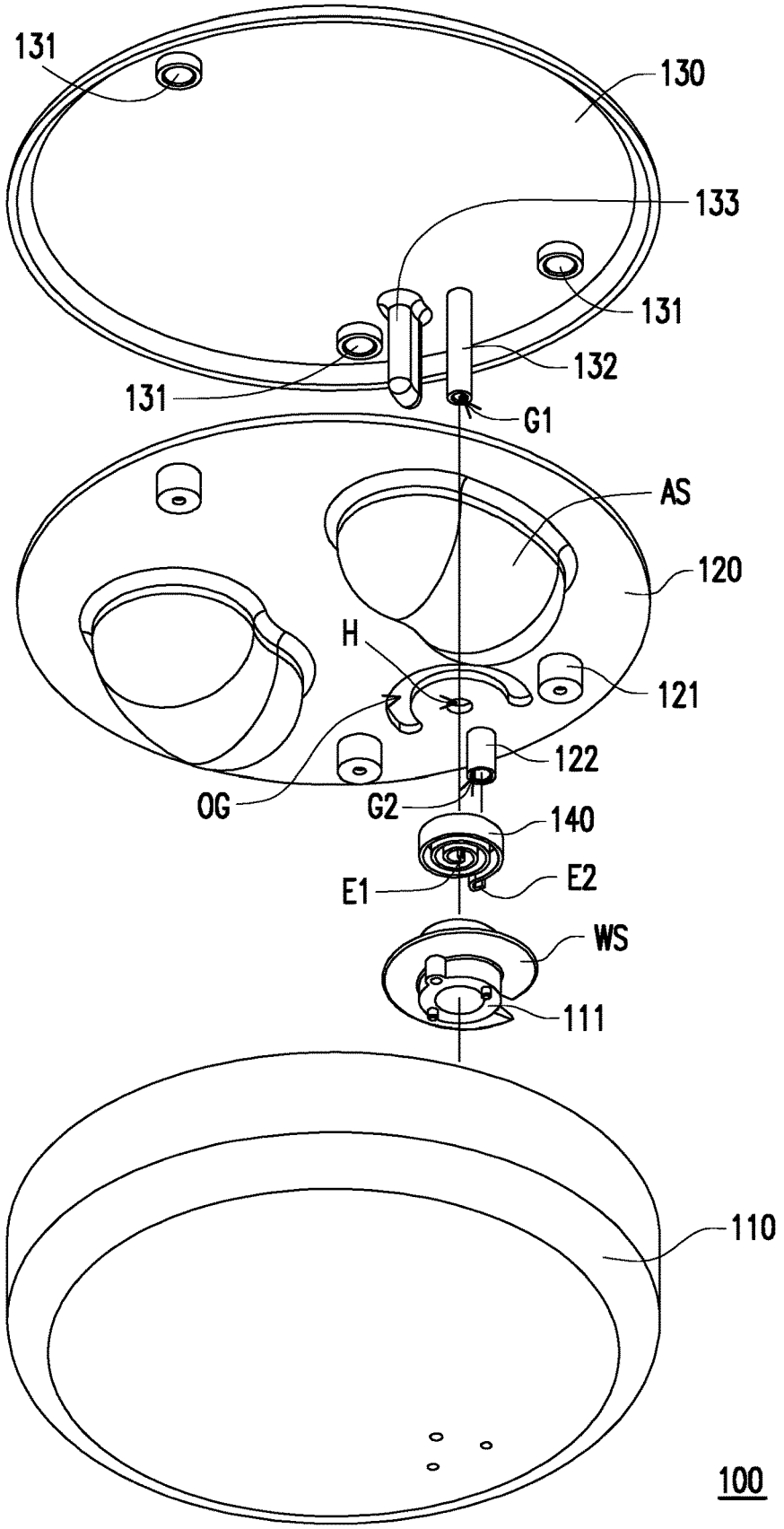
FIG. 1C is an exploded perspective view of the components of the earphone case of FIG. 1A from another direction.
Figure 1D:
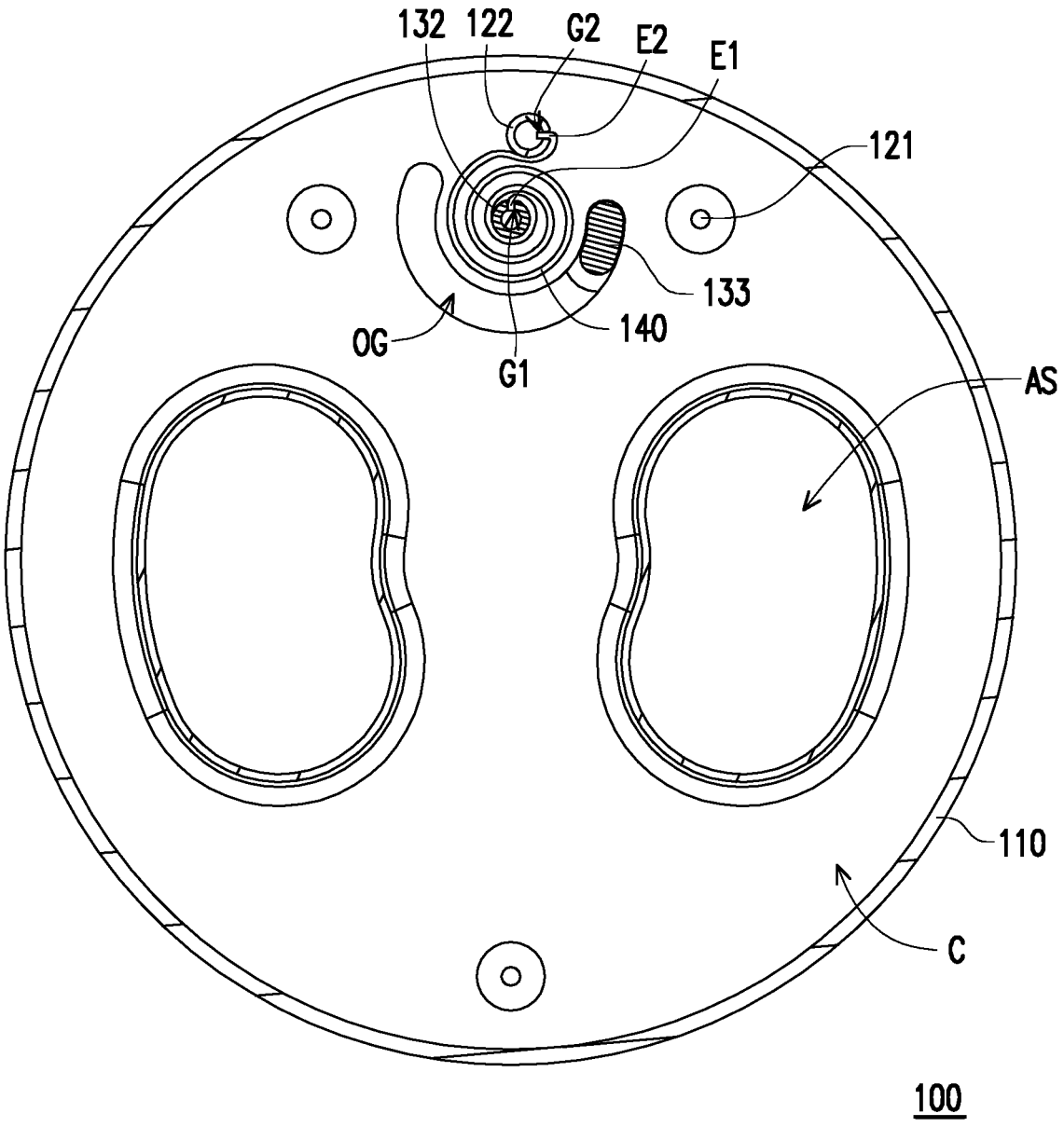
FIG. 1D is a bottom cross-sectional view of the earphone case of FIG. 1A taken along line segment A-A.
Figure 1E:
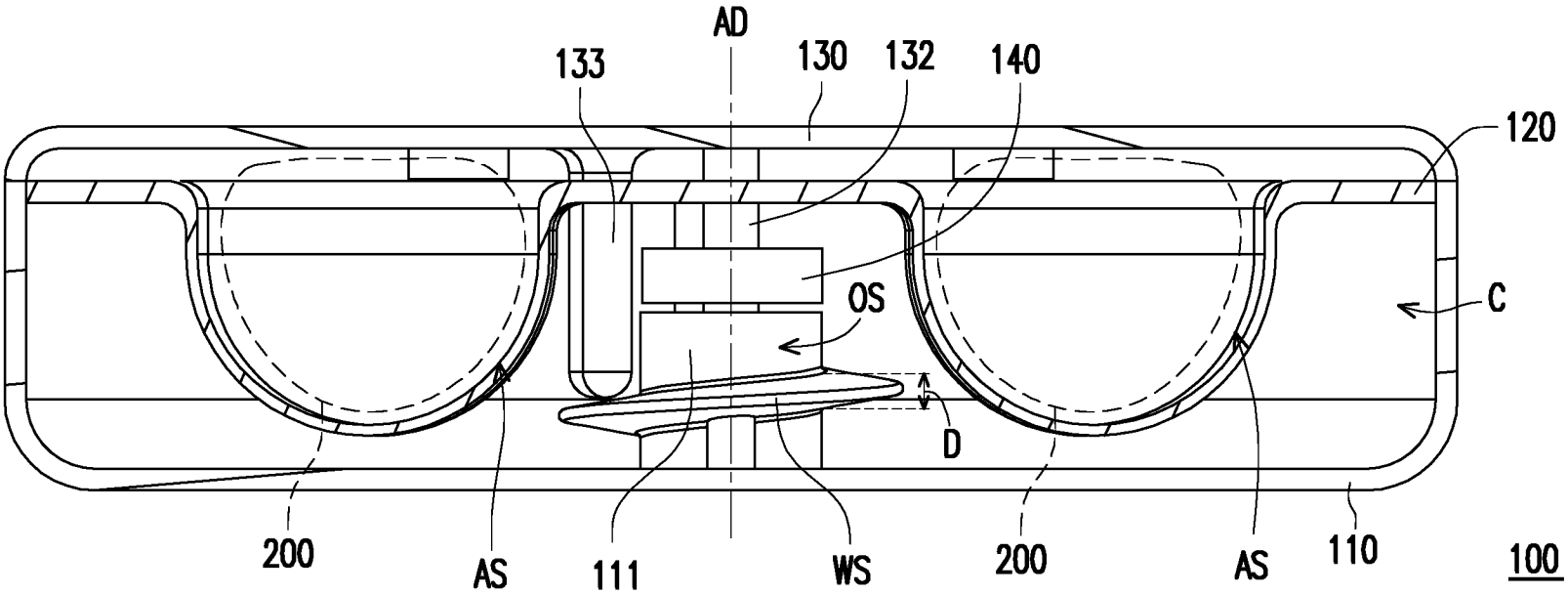
FIG. 1E is a front cross-sectional view of the earphone case of FIG. 1A taken along line segment B-B.

FIG. 1A is a perspective view of an earphone case in close mode according to an embodiment of the disclosure. FIG. 1B is an exploded perspective view of components of the earphone case of FIG. 1A. FIG. 1C is an exploded perspective view of the components of the earphone case of FIG. 1A from another direction. FIG. 1D is a bottom cross-sectional view of the earphone case of FIG. 1A taken along line segment A-A. FIG. 1E is a front cross-sectional view of the earphone case of FIG. 1A taken along line segment B-B.

Referring to FIG. 1A, an earphone case 100 of the disclosure is configured to store wireless earphones or wired earphones and has the effect of automatically opening and positioning the cover. The earphone case 100 is suitable for replacing conventional earphone cases whose covers are manually adjusted.

Referring to FIG. 1A to FIG. 1C, the earphone case 100 of the disclosure includes a body 110, a storage member 120, a cover 130, and a reset member 140.

The body 110 has a chamber C and a fixing base 111. In the embodiment, the body 110 is presented with a circular appearance and the chamber C is recessed in the body 110 and has an opening OP. The fixing base 111 is securely disposed in the chamber C and located on the bottom of the body 110. The storage member 120 is disposed in the body 110 and located above the fixing base 111. The storage member 120 is contacted with the body 110 and shields the opening OP of the chamber C.

The storage member 120 has a plurality of first magnetic parts 121 and two storage spaces AS. The plurality of first magnetic parts 121 are spaced apart from each other and adjacent to the edge of the storage member 120. The two storage spaces AS are recessed and extend into the chamber C, and are provided symmetrical to each other.

The cover 130 is pivotally connected to the storage member 120 and the fixing base 111, and the cover 130 has a plurality of second magnetic parts 131. The plurality of second magnetic parts 131 are disposed on the bottom surface of the cover 130 facing the storage member 120. The reset member 140 is disposed above the fixing base 111 and connected to the cover 130 and the storage member 120 respectively.

Figure 2A:
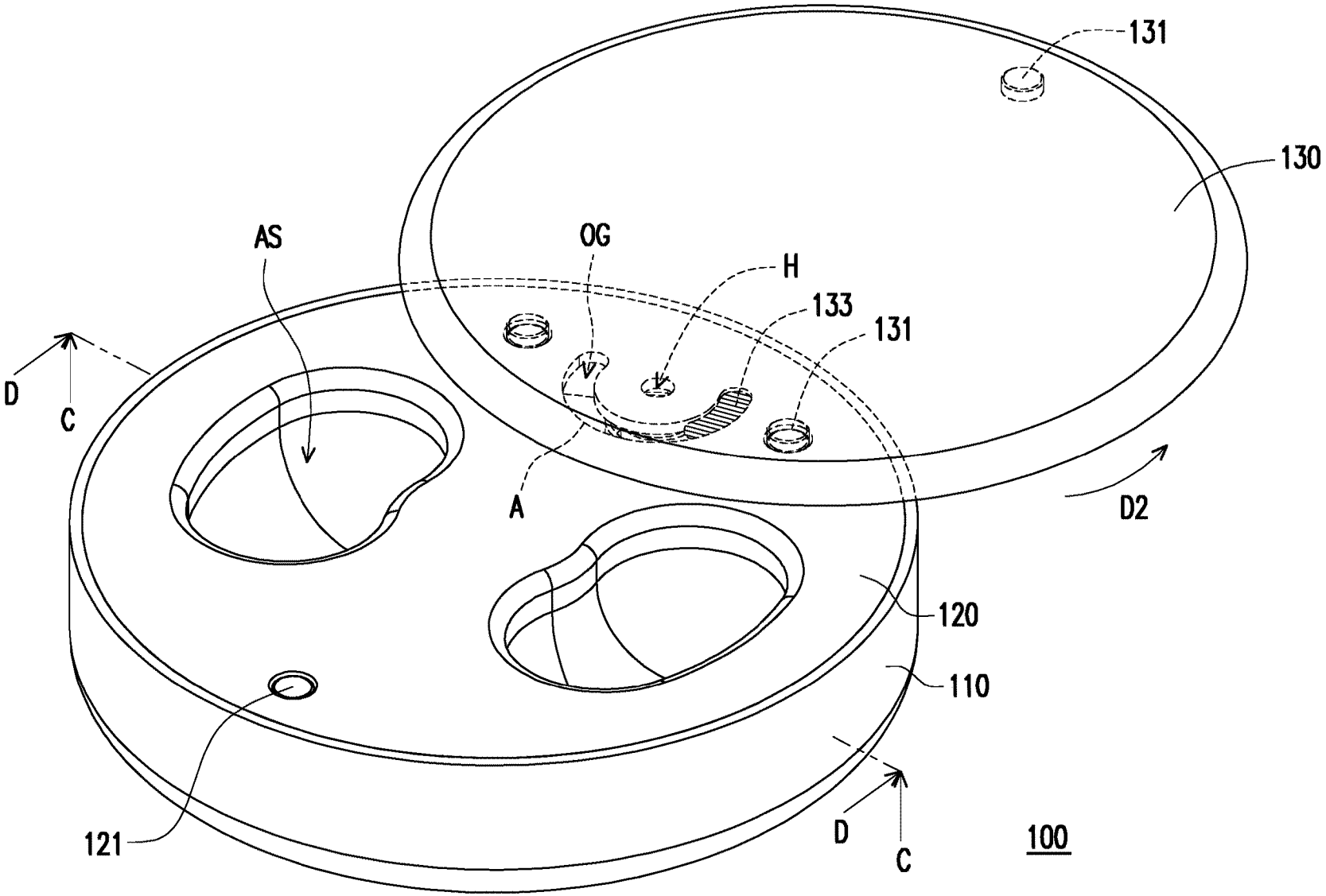
FIG. 2A is a perspective view of the earphone case of FIG. 1A in open mode.

Referring to FIG. 1A and FIG. 1E, in close mode, the cover 130 completely covers the storage member 120, and the plurality of first magnetic parts 121 and the plurality of second magnetic parts 131 are magnetically attracted to each other. Referring to FIG. 2A, in open mode, the reset member 140 drives the cover 130 to be relatively separated from the storage member 120 and rotated at an angle A, such that the cover 130 partially overlaps with the storage member 120, and part of the plurality of first magnetic parts 121 and part of the plurality of second magnetic parts 131 are magnetically attracted to each other.

Further, each of the first magnetic parts 121 is a magnet or a magnetic material and each of the second magnetic parts 131 is a magnetic material or a magnet. When the magnet is close to the magnetic material, the cover 130 is positioned on the storage member 120 through the magnetic attraction force of the magnet. In another embodiment, each of the first magnetic parts 121 and each of the second magnetic parts 131 are all magnets. When the two are in contact with each other, a high-strength magnetic attraction force is produced, such that the cover 130 and the storage member 120 do not easily fall off due to a collision of external force.

Referring to FIG. 1A to FIG. 1D, the storage member 120 has a perforation H and the cover 130 has a rotating shaft 132. The rotating shaft 132 is passed through the perforation H and pivotally connected to the fixing base 111. The cover 130 is adapted to pivotally rotate relative to the storage member 120 through the rotating shaft 132 to switch to open mode or close mode.

The bottom surface facing the fixing base 111 of the storage member 120 has a positioning pillar 122. The reset member 140 is, for example, a vortex spring, and the reset member 140 is engaged with the positioning pillar 122 and the rotating shaft 132. In detail, the rotating shaft 132 has a first slot G1. The positioning pillar 122 has a second slot G2. The first slot G1 and the second slot G2 are radially formed on the rotating shaft 132 and the positioning pillar 122 respectively. The reset member 140 surrounds the rotating shaft 132 and has a first end part E1 and a second end part E2. The first end part E1 is disposed in the first slot G1 and the second end part E2 is disposed in the second slot G2.

Under such case, when the rotating shaft 132 rotates, the reset member 140 is driven to be elastically deformed or the reset member 140 is driven to be elastically restored.

Figure 2B:
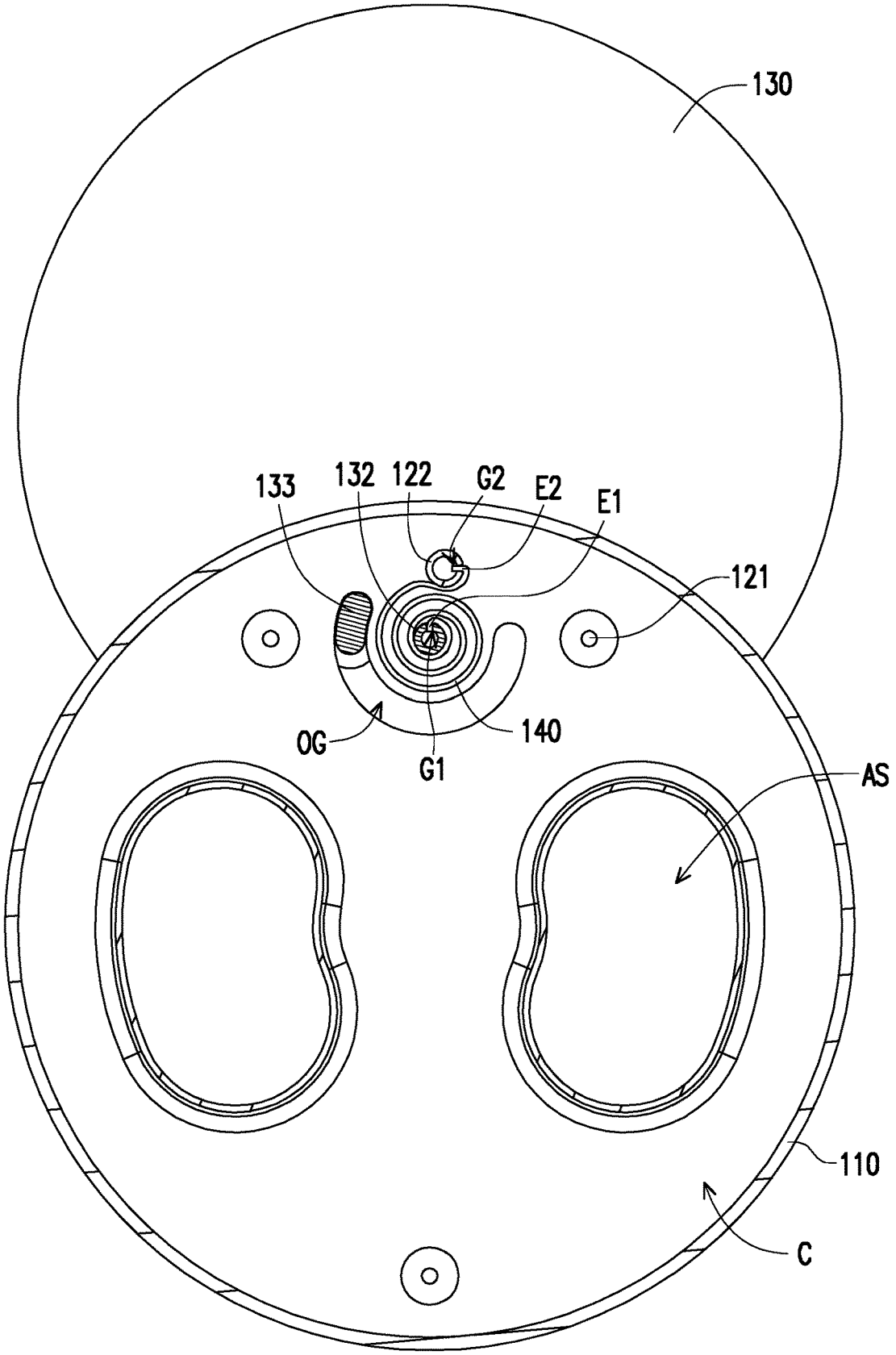
FIG. 2B is a bottom cross-sectional view of the earphone case of FIG. 2A taken along line segment C-C.
Figure 2C:
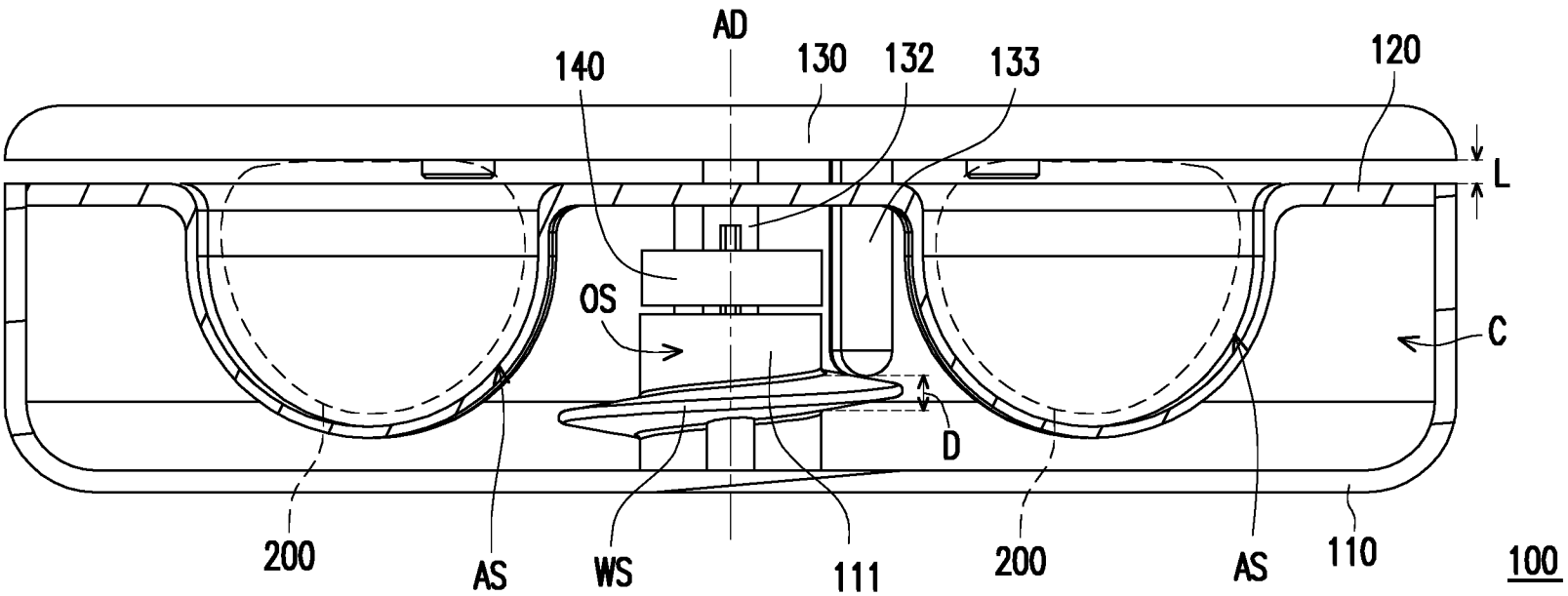
FIG. 2C is a front cross-sectional view of the earphone case of FIG. 2A taken along line segment D-D.

FIG. 2A is a perspective view of the earphone case of FIG. 1A in open mode. FIG. 2B is a bottom cross-sectional view of the earphone case of FIG. 2A taken along line segment C-C. FIG. 2C is a front cross-sectional view of the earphone case of FIG. 2A taken along line segment D-D.

Referring to FIG. 1A, FIG. 1E, FIG. 2A, and FIG. 2B, a spiral curved surface WS is further included. The spiral curved surface WS is disposed on an outer surface OS of the fixing base 111 and gradually climbs up along an axial direction AD of the fixing base 111. In the embodiment, the spiral curved surface WS has a height difference D of 0.5 mm to 2.0 mm. In other embodiments, the height difference of the spiral curved surface may be less than 0.5 mm or greater than 2.0 mm. The designer can freely change the height difference according to requirements and the disclosure is not limited thereto.

The cover 130 has a guiding post 133. The guiding post 133 penetrates the storage member 120 and is in contact with the spiral curved surface WS. The guiding post 133 is adapted to be raised and lowered along the spiral curved surface WS. In open mode (see FIG. 2A, FIG. 2B, and FIG. 2C), there is a distance L between the cover 130 and the storage member 120. In close mode, the cover 130 and the storage member 120 are in close contact with each other (see FIG. 1A and FIG. 1E).

Referring to FIG. 1A and FIG. 2A, the storage member 120 has an arcuate groove OG. The guiding post 133 of the cover 130 is passed through the arcuate groove OG and adapted to move back and forth along the arcuate groove OG to switch to close mode or open mode.

In addition, referring to FIG. 1E and FIG. 2C. When the earphone case 100 is in close mode, the cover 130 is in close contact with the storage member 120 and an earphone unit 200 is accommodated. When the earphone case 100 is switched to open mode, the cover 130 is guided by the spiral curved surface WS and adapted to gradually climb up the distance L of 0.5 mm to 2.0 mm, but not limited thereto, such that during the rotation of the cover 130, the lower edge of the cover 130 gradually moves up and away from the earphone unit 200, preventing the earphone unit 200 from obstructing the automatic opening of the cover 130, such that the earphone unit 200 may protrude above the storage member 120 when placed in the earphone case 100, thereby facilitating user access.

The automatic opening of the earphone case 100 will be described below.

Referring to FIG. 1A to FIG. 1D, when the earphone case 100 is in close mode (see FIG. 1A), the cover 130 completely covers the storage member 120, and the plurality of second magnetic parts 131 are magnetically attracted to the plurality of first magnetic parts 121 respectively. At this time, the cover 130 is rotated relative to the storage member 120 toward a first direction D1 and the rotating shaft 132 drives the reset member 140 to be rotated to produce elastic deformation and accumulate elastic force.

In addition, the plurality of first magnetic parts 121 include three magnetic parts, wherein two of the first magnetic parts 121 are disposed on opposite sides of the arcuate groove OG and the other one of the first magnetic parts 121 is disposed on the opposite side of the two first magnetic parts 121. The plurality of second magnetic parts 131 include three magnetic parts.

Referring to FIG. 2A to FIG. 2C, an external force is exerted to the cover 130 to disengage the three second magnetic parts 131 of the cover 130 from the three first magnetic parts 121 respectively, so as to eliminate the magnetic attraction state. At this time, the cover 130 is rotated relative to the storage member 120 toward a second direction D2 opposite to the first direction D1. The reset member 140 elastically recovers and releases elastic force to drive the rotating shaft 132 and the cover 130 to continue to rotate to a specific position.

In detail, in open mode, the angle A of rotation of the cover 130 relative to the storage member 120 is 180 degrees, such that two of the first magnetic parts 121 magnetically attract corresponding two of the second magnetic parts 131, and the other first magnetic part 121 is separated from the other corresponding second magnetic part 131. Finally, the cover 130 only partially overlaps with the storage member 120 to expose the two storage spaces AS of the storage member 120 and the two earphone units 200.

Based on the above, in the earphone case of the disclosure, the body and the storage member are contacted with each other, and the cover is pivotally connected to the fixing base of the body and the storage member. The storage member and the cover are connected by the reset member, when the earphone case is in close mode, the cover covers the storage member, and the plurality of first magnetic parts and the plurality of second magnetic parts are magnetically attracted to each other to position the cover. When the earphone case is in open mode, an external force needs to be exerted to overcome the magnetic attraction of the plurality of first magnetic parts and the plurality of second magnetic parts. Then, the cover is driven by the reset member to be rotated to a fixed position relative to the storage member, such that corresponding part of the plurality of first magnetic parts and part of the plurality of second magnetic parts are magnetically attracted to each other. As such, the effect of automatically opening the cover can be achieved without having to manually adjust the position of the cover.

Although the disclosure has been disclosed in the above embodiments, the embodiments are not intended to limit the disclosure. It will be apparent to persons skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An earphone case, comprising:

a body having a chamber and a fixing base, wherein the fixing base is disposed in the chamber;

a storage member disposed in the chamber, located above the fixing base and contacted with the body, and the storage member having a plurality of first magnetic parts;

a cover pivotally connected to the storage member and the fixing base, and the cover having a plurality of second magnetic parts;

a reset member disposed above the fixing base, and the reset member connected to the cover and the storage member respectively, wherein in close mode, the cover completely covers the storage member and the plurality of first magnetic parts magnetically attract the plurality of second magnetic parts respectively, in open mode, the reset member drives the cover to be relatively separated from the storage member and rotated at an angle, such that the cover partially overlaps with the storage member and part of the plurality of first magnetic parts magnetically attract part of the plurality of second magnetic parts respectively.

2. The earphone case according to claim 1, further comprising a spiral curved surface disposed around an outer surface of the fixing base, wherein the cover has a guiding post penetrating the storage member and in contact with the spiral curved surface, the guiding post is adapted to be raised and lowered along the spiral curved surface, and a gap is formed between the cover and the storage member in open mode.

3. The earphone case according to claim 2, wherein the spiral curved surface has a height difference of 0.5 mm to 2.0 mm.

4. The earphone case according to claim 2, wherein the storage member has an arcuate groove, the guiding post is passed through the arcuate groove and adapted to move back and forth along the arcuate groove to switch to close mode or open mode.

5. The earphone case according to claim 4, wherein the plurality of first magnetic parts comprise three magnetic parts, two of the first magnetic parts are disposed on opposite sides of the arcuate groove and the other first magnetic part is disposed on an opposite side of the two first magnetic parts, in open mode, the cover is rotated relative to the storage member at the angle of 180 degrees, such that the two of the first magnetic parts magnetically attract corresponding two of the second magnetic parts, and the other first magnetic part is separated from the other corresponding second magnetic part.

6. The earphone case according to claim 1, wherein the storage member has a perforation, the cover has a rotating shaft, and the rotating shaft is passed through the perforation and pivotally connected to the fixing base.

7. The earphone case according to claim 6, wherein a bottom surface facing the fixing base of the storage member has a positioning pillar, the reset member is a vortex spring, and the reset member is engaged with the positioning pillar and the rotating shaft.

8. The earphone case according to claim 7, wherein the rotating shaft has a first slot, the positioning pillar has a second slot, the reset member surrounds the rotating shaft and has a first end part and a second end part, the first end part is disposed in the first slot, and the second end part is disposed in the second slot.

9. The earphone case according to claim 6, wherein when the cover is rotated relative to the storage member toward a first direction, the rotating shaft drives the reset member to elastically deform.

10. The earphone case according to claim 9, wherein when the cover is rotated relative to the storage member toward a second direction opposite to the first direction, the reset member is elastically restored to drive the rotating shaft and the cover to rotate to a specific position.

11. The earphone case according to claim 1, wherein the storage member has two storage spaces recessed in the chamber.

12. The earphone case according to claim 1, wherein each of the first magnetic parts is a magnet or a magnetic material and each of the second magnetic parts is a magnetic material or a magnet.

13. The earphone case according to claim 1, wherein each of the first magnetic parts and each of the second magnetic parts are magnets.

* * * * *